US009938110B2

(12) United States Patent
Awano

(10) Patent No.: US 9,938,110 B2
(45) Date of Patent: Apr. 10, 2018

(54) FOLDING PROCESSING DEVICE HAVING A GUIDING PORTION

(71) Applicant: FUJI XEROX CO., LTD., Tokyo (JP)

(72) Inventor: Hiroaki Awano, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/062,486

(22) Filed: Mar. 7, 2016

(65) Prior Publication Data

US 2017/0088386 A1 Mar. 30, 2017

(30) Foreign Application Priority Data

Sep. 24, 2015 (JP) ..... 2015-187168

(51) Int. Cl.

| | |
|---|---|
| ***B65H 37/06*** | (2006.01) |
| ***B65H 29/52*** | (2006.01) |
| ***B65H 45/18*** | (2006.01) |
| ***B65H 45/30*** | (2006.01) |

(52) U.S. Cl.

CPC ..... *B65H 37/06* (2013.01); *B65H 29/52* (2013.01); *B65H 45/18* (2013.01); *B65H 45/30* (2013.01); *B65H 2220/09* (2013.01); *B65H 2301/51232* (2013.01); *B65H 2404/63* (2013.01); *B65H 2404/693* (2013.01); *B65H 2701/13212* (2013.01); *B65H 2701/18292* (2013.01); *B65H 2801/27* (2013.01); *B65H 2801/48* (2013.01)

(58) Field of Classification Search

CPC ..... B65H 37/06; B65H 29/52; B65H 45/30; B65H 45/14

See application file for complete search history.

(56) References Cited

U.S. PATENT DOCUMENTS

2012/0065046 A1* 3/2012 Dobashi ..... B65H 45/18 493/454
2015/0183612 A1* 7/2015 Awano ..... B65H 45/18 493/454

FOREIGN PATENT DOCUMENTS

| | | | |
|---|---|---|---|
| JP | 63-017110 | A | 1/1988 |
| JP | 02-42650 | B2 | 9/1990 |
| JP | 2004-059304 | A | 2/2004 |
| JP | 4940771 | B2 | 5/2012 |
| JP | 2012166941 | A * | 9/2012 |
| JP | 2013-014431 | A | 1/2013 |

(Continued)

OTHER PUBLICATIONS

Communication dated Jan. 5, 2016 from the Japan Patent Office in counterpart application No. 2015-187168.

*Primary Examiner* — Patrick H Mackey
(74) *Attorney, Agent, or Firm* — Sughrue Mion, PLLC

(57) ABSTRACT

A folding processing device includes a pressing section that includes a first opposing member and a second opposing member, the first opposing member opposing a folded portion of a folded sheet, the second opposing member opposing the first opposing member with the folded portion interposed therebetween, the pressing section pressing the folded portion by nipping the folded portion by using the first opposing member and the second opposing member; and a guiding section that is disposed upstream from the pressing section in a sheet transport direction, the guiding section nipping the sheet whose folded portion has passed through the guiding section and guiding the sheet to the pressing section.

13 Claims, 13 Drawing Sheets

(56) References Cited

FOREIGN PATENT DOCUMENTS

| | | | | |
|---|---|---|---|---|
| JP | 2013-056730 | A | | 3/2013 |
| JP | 2013056730 | A | * | 3/2013 |

* cited by examiner

FOLDING PROCESSING DEVICE HAVING A GUIDING PORTION

CROSS-REFERENCE TO RELATED APPLICATIONS

This application is based on and claims priority under 35 USC 119 from Japanese Patent Application No. 2015-187168 filed Sep. 24, 2015.

BACKGROUND

Technical Field

The present invention relates to a folding processing device, a sheet processing device, and an image forming system.

SUMMARY

According to an aspect of the invention, there is provided a folding processing device including a pressing section that includes a first opposing member and a second opposing member, the first opposing member opposing a folded portion of a folded sheet, the second opposing member opposing the first opposing member with the folded portion interposed therebetween, the pressing section pressing the folded portion by nipping the folded portion by using the first opposing member and the second opposing member; and a guiding section that is disposed upstream from the pressing section in a sheet transport direction, the guiding section nipping the sheet whose folded portion has passed through the guiding section and guiding the sheet to the pressing section.

BRIEF DESCRIPTION OF THE DRAWINGS

An exemplary embodiment of the present invention will be described in detail based on the following figures, wherein.

DETAILED DESCRIPTION

An exemplary embodiment of the present invention is hereunder described in detail with reference to the attached drawings.

Structure of Image Forming System

Figure 1:
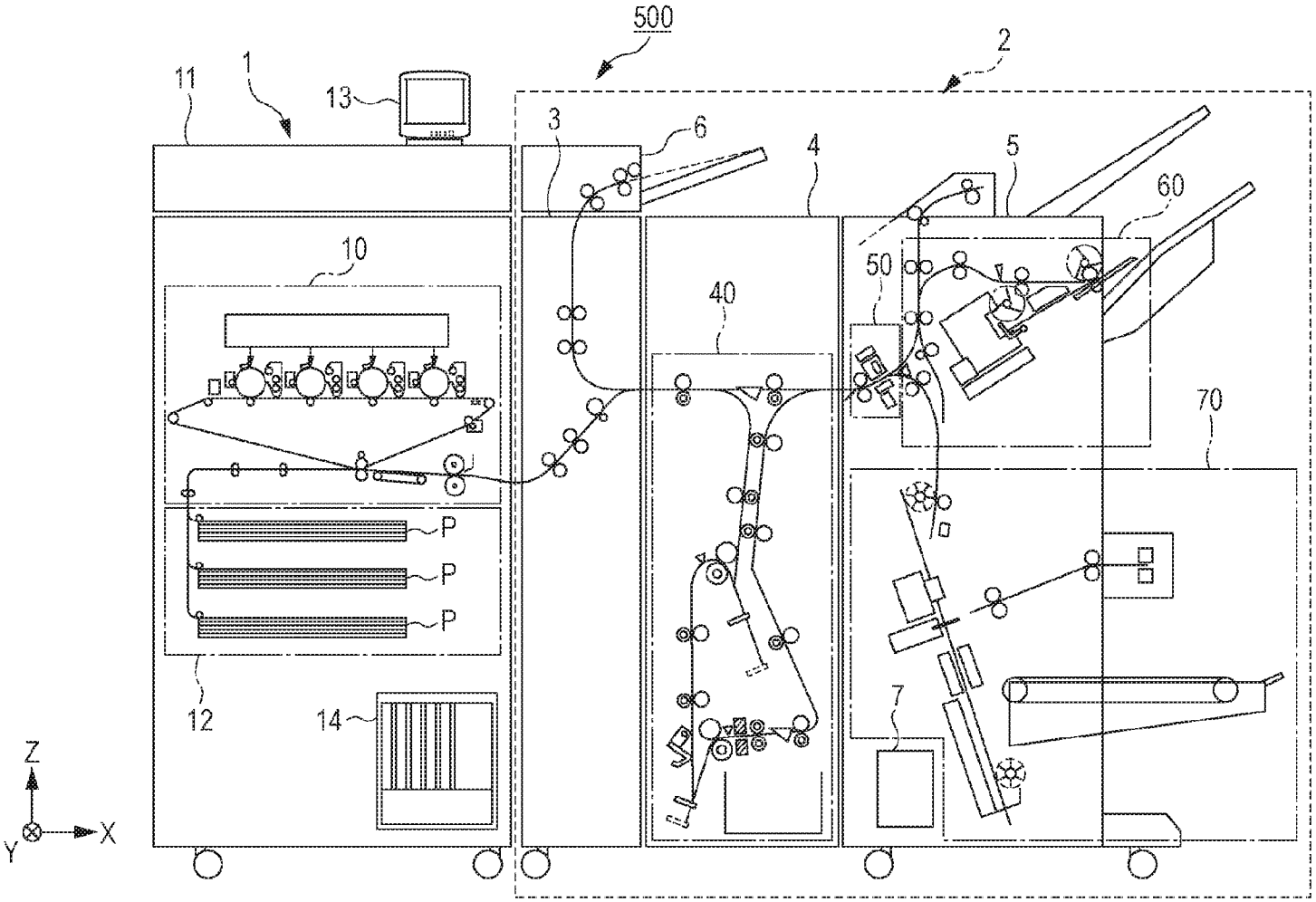
FIG. 1 is an explanatory view of an image forming system.

FIG. 1 is an explanatory view of an image forming system 500 to which the exemplary embodiment is applied.

The image forming system 500 includes an image forming apparatus 1 that forms images on a sheet P, which is an example of a sheet; and a postprocessing device 2 that performs postprocessing on the sheets P on which the images have been formed by the image forming apparatus 1. In the description below, in FIG. 1, a direction from left to right is called a direction X, a direction from a near side to a far side is called a direction Y, and a direction from a lower side to an upper side is called a direction Z.

First, the image forming apparatus 1 includes an image forming unit 10 that forms images on the basis of pieces of image data concerning corresponding colors, an image reading unit 11 that reads an image form an original and generates read image data, a sheet supplying unit 12 that supplies sheets P to the image forming unit 10, a user interface 13 that accepts an operation from a user and provides information to the user, and a main controller 14 that controls the operation of the entire image forming system 500.

The postprocessing device 2 includes a transport unit 3 that receives the sheets P on which the images have been formed from the image forming apparatus 1 and transports these sheet P, a folding unit 4 that performs, as appropriate, a folding operation on the sheets P that have been transported into the folding unit 4 from the transport unit 3, and a postprocessing unit 5 that performs other postprocessing operations on the sheets P that have been transported into the postprocessing unit 5 from the folding unit 4. The postprocessing device 2 also includes an inserting paper supplying unit (interposer) 6 that supplies inserting paper, which is used as, for example, a cover of a booklet, to the transport unit 3. The postprocessing device 2 further includes a sheet processing controller 7 that controls the operation of each functional unit of the postprocessing device 2.

Of these, the folding unit 4 includes a folding section 40 that performs a folding operation, such as so-called C folding or Z folding, on sheets P (including inserting paper) that are transported into the folding unit 4 from the transport unit 3.

The postprocessing unit 5 includes a hole puncher 50 that punches, for example, two holes or four holes as appropriate in the sheets P (including inserting paper) that are transported into the postprocessing unit 5 from the folding unit 4. The postprocessing unit 5 also includes an edge stitching section 60 that forms a sheet bundle by accumulating the necessary number of sheets P (including inserting paper) that have passed through the hole puncher 50, and staples (stitches) an end portion of the formed sheet bundle. The postprocessing unit 5 further includes a saddle-stitching bookbinding section 70 that, after forming the sheet bundle by accumulating the necessary number of sheets P (including inserting paper) that have passed through the hole puncher 50 and by stapling (saddle-stitching) a central portion of the formed sheet bundle, performs a folding operation on the central portion of the sheet bundle (saddle-stitched portion serving as an example of a folded portion) to form a booklet (that is, to perform a simple bookbinding operation).

Although, in this exemplary embodiment, the sheet processing controller 7 is exemplified as being provided in the postprocessing unit 5 of the postprocessing device 2, the sheet processing controller 7 may be provided in any other unit of the postprocessing device 2 (the transport unit 3, the folding unit 4, or the inserting paper supplying unit 6). Although, in the exemplary embodiment, the sheet processing controller 7 is exemplified as being provided in the postprocessing device 2, the sheet processing controller 7 may be provided in the image forming apparatus 1. Alternatively, instead of separately providing the main controller 14 and the sheet processing controller 7, the main controller 14 may also function as the sheet processing controller 7.

Structure of Postprocessing Unit

Figure 2:
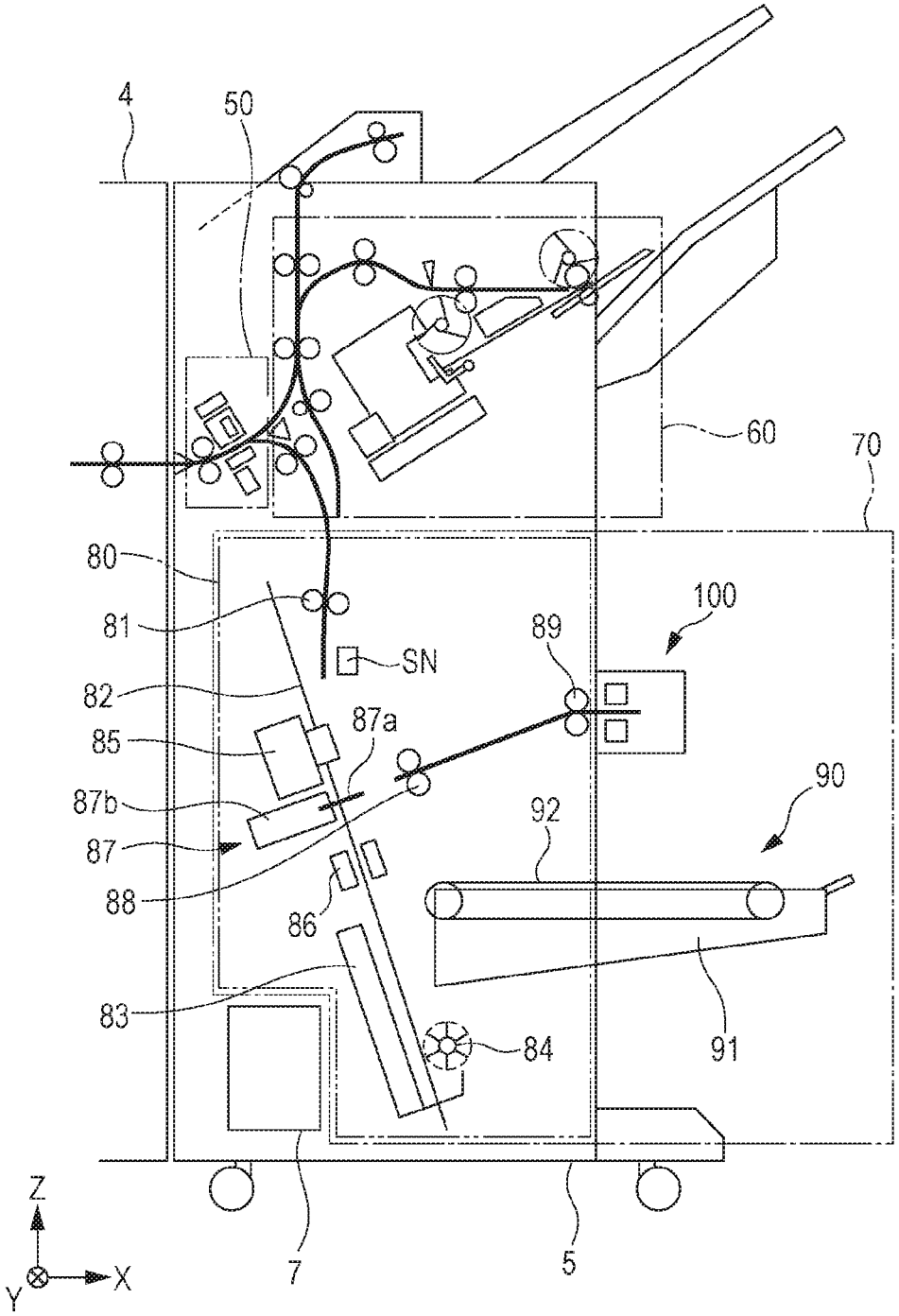
FIG. 2 is an explanatory view of a postprocessing unit of a postprocessing device.

FIG. 2 is an explanatory view of the postprocessing unit 5 of the postprocessing device 2.

As described above, the postprocessing unit 5 according to the exemplary embodiment includes the hole puncher 50, the edge stitching section 60, and the saddle-stitching bookbinding section 70. In the postprocessing unit 5, the hole puncher 50 and the edge stitching section 60 are disposed above the saddle-stitching bookbinding section 70.

Next, the saddle-stitching bookbinding section 70 of the postprocessing unit 5 is described in more detail.

The saddle-stitching bookbinding section 70, which is an example of a sheet processing device, includes a booklet forming section 80, a fold enhancing section 100, and a booklet placement section 90. The booklet forming section 80 accumulates the necessary number of sheets P (including inserting paper) that have passed through the hole puncher 50 to form a sheet bundle, staples (saddle-stitches) a central portion of the formed sheet bundle, and, then, performs a folding operation on the central portion (saddle-stitched portion) of the sheet bundle to form a booklet. The fold enhancing section 100 further performs a folding operation (fold enhancing operation) on the saddle-stitched portion of the booklet that is transported into the fold enhancing section 100 from the booklet forming section 80. The booklet that has been subjected to the fold enhancing operation and that is discharged from the fold enhancing section 100 falls and is placed on the booklet placement section 90.

The booklet forming section 80, which is an example of a folding processing section, includes a pair of transport-in rollers 81, a plate-like accumulation member 82, and a supporting member 83. The pair of transport-in rollers 81 transport downward one sheet at a time the sheets P that are transported between the transport-in rollers 81 from the hole puncher 50. The plate-like accumulation member 82 accumulates the necessary number of sheets P that are transported to the plate-like accumulation member 82 by using the transport-in rollers 81, and forms the sheet bundle. The supporting member 83 supports the sheet bundle on the accumulation member 82 from below the accumulation member 82. Here, the supporting member 83 is movable in an up-down direction in accordance with the size of the sheets P that are to be accumulated on the accumulation member 82.

The booklet forming section 80 also includes a paddle 84, a width-direction aligning member 85, and a stapler 86. The paddle 84 aligns edges of the sheets P that are accumulated on the accumulation member 82 by urging the sheets P towards the supporting member 83. The width-direction aligning member 85 aligns the sheets P that are accumulated on the accumulation member 82 in the width direction. The stapler 86 stitches (saddle-stitches) the central portion of the sheet bundle on the accumulation member 82 by driving staples (not shown) into the central portion of the sheet bundle.

Further, the booklet forming section 80 includes a folding processing mechanism 87 that performs a folding processing operation on the central portion (saddle-stitched portion) of the sheet bundle that has been stitched (saddle-stitched) by the stapler 86. The folding processing mechanism 87 includes a folding knife 87*a* and an advancing-and-retreating mechanism 87*b* that causes the folding knife 87*a* to advance and retreat between a back surface side of the accumulation member 82 and a side where the sheet bundle is accommodated.

Further, the booklet forming section 80 includes a pair of nipping rollers 88 that nip the sheet bundle (booklet) that has been folded by the folding knife 87*a*, and a pair of transport-out rollers 89 that transport the booklet that has passed between the nipping rollers 88 towards the fold enhancing section 100. Here, the transport-out rollers 89, which are examples of transporting members, transport the booklet in the direction X.

The fold enhancing section 100, which is an example of a folding processing device, is unitized, and is mountable on and dismountable from the postprocessing unit 5. Therefore, it is assumed that the fold enhancing section 100 is sold with the fold enhancing section 100 being mounted on the postprocessing unit 5, and that the fold enhancing section 100 is sold without the fold enhancing section 100 being mounted on the postprocessing unit 5. In addition, in the case of the latter, the fold enhancing section 100 that has been separately acquired may be mounted on the postprocessing unit 5 afterwards.

The fold enhancing section 100 according to the exemplary embodiment is mounted while being exposed to the outside of a housing of the postprocessing unit 5 (to the right side in FIG. 2) for the purpose of easily mounting the fold enhancing section 100 on the postprocessing unit 5 afterwards, and for the purpose of easily supplying the booklet to the booklet placement section 90 (described below).

The structure of the fold enhancing section 100 is described in detail below.

The booklet placement section 90 according to the exemplary embodiment is provided below the fold enhancing section 100. That is, the booklet placement section 90 is provided at a location where it is capable of receiving the booklet that is discharged from the fold enhancing section 100 and that falls.

The booklet placement section 90 according to the exemplary embodiment includes a placement table 91 and a transport belt 92. The placement table 91 is mounted on the housing of the postprocessing unit 5 such that part of the placement table 91 protrudes to the outside of the housing (to the right in FIG. 2). The transport belt 92 is provided at an upper surface of the placement table 91 (surface of the placement table 91 facing the fold enhancing section 100), and transports the booklet discharged from the fold enhancing section 100 in the direction X.

Structure of Fold Enhancing Section

Figure 3A:
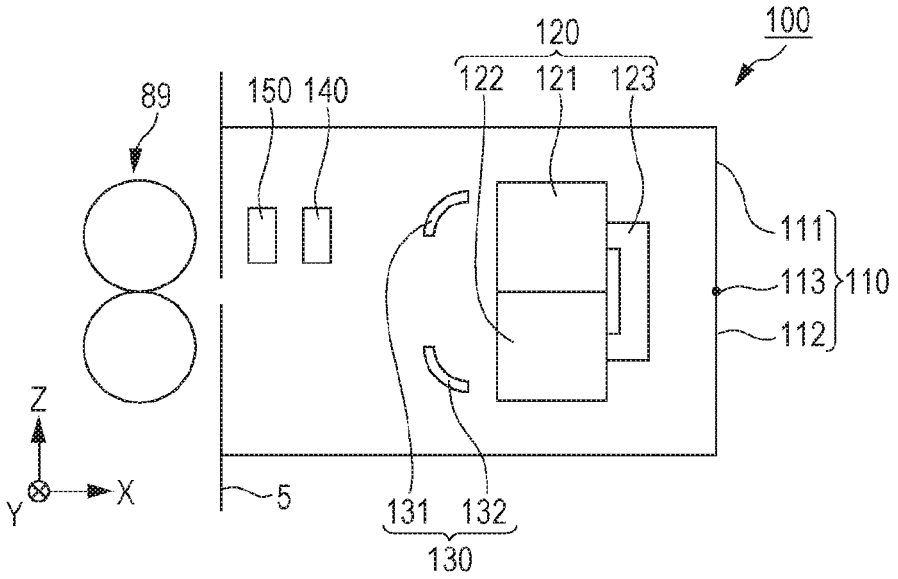
FIGS. 3A and 3B are each an XZ sectional view of a fold enhancing section.
Figure 3B:
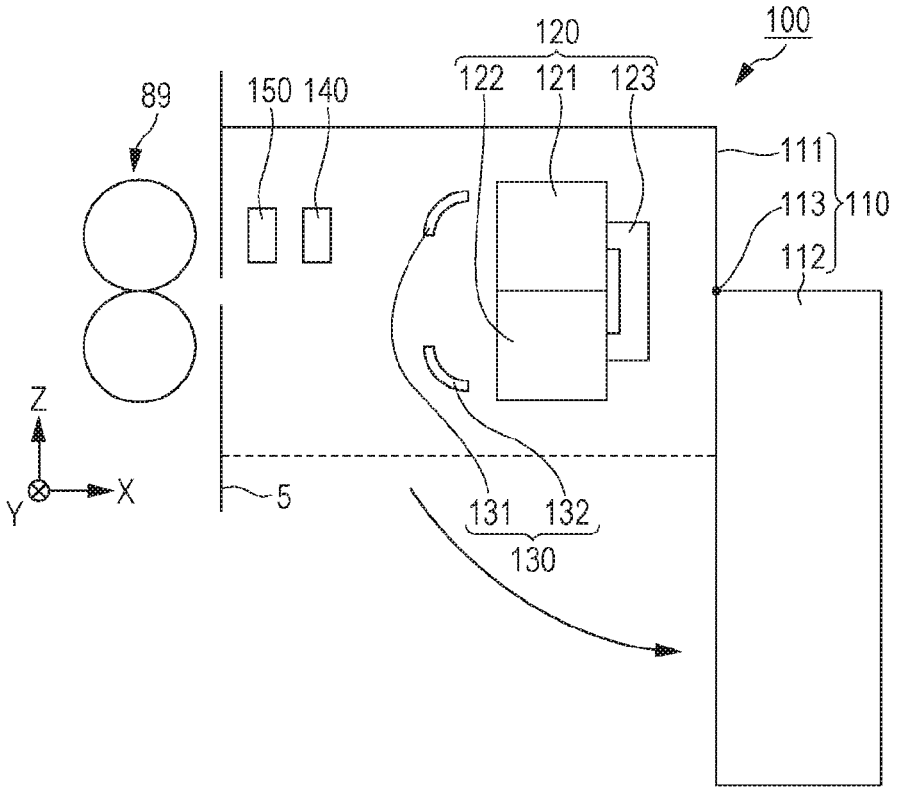

FIGS. 3A and 3B are each an XZ sectional view of the fold enhancing section 100. Here, FIG. 3A illustrates the fold enhancing section 100 in a "closed state". FIG. 3B illustrates the fold enhancing section 100 in an "open state". FIGS. 3A and 3B also illustrate the transport-out rollers 89 provided in the postprocessing unit 5. The "closed state" and the "open state" of the fold enhancing section 100 are described below.

Figure 4A:
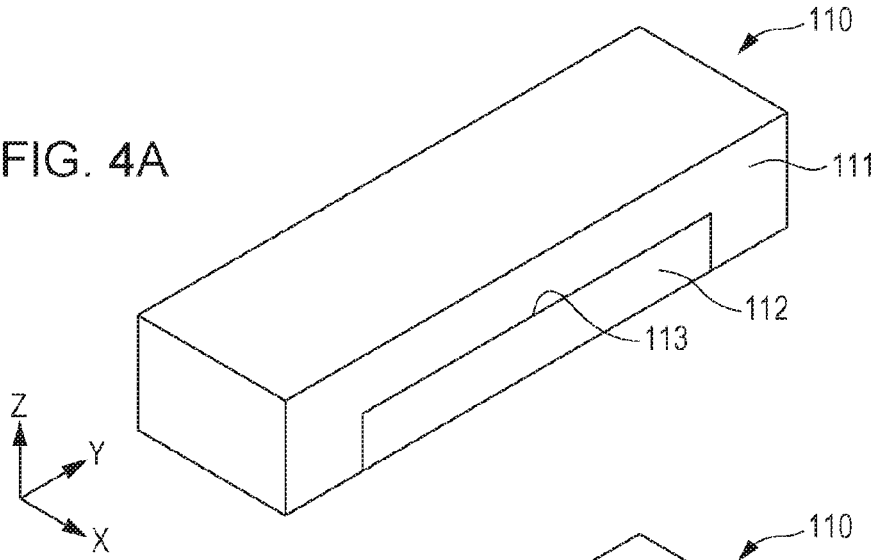
FIGS. 4A to 4C are each a perspective view of a housing of the fold enhancing section.
Figure 4B:
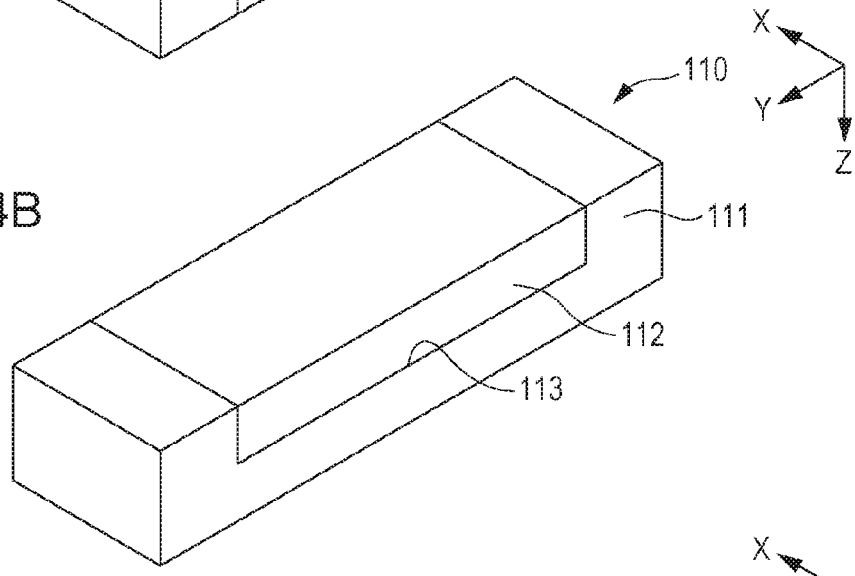
Figure 4C:
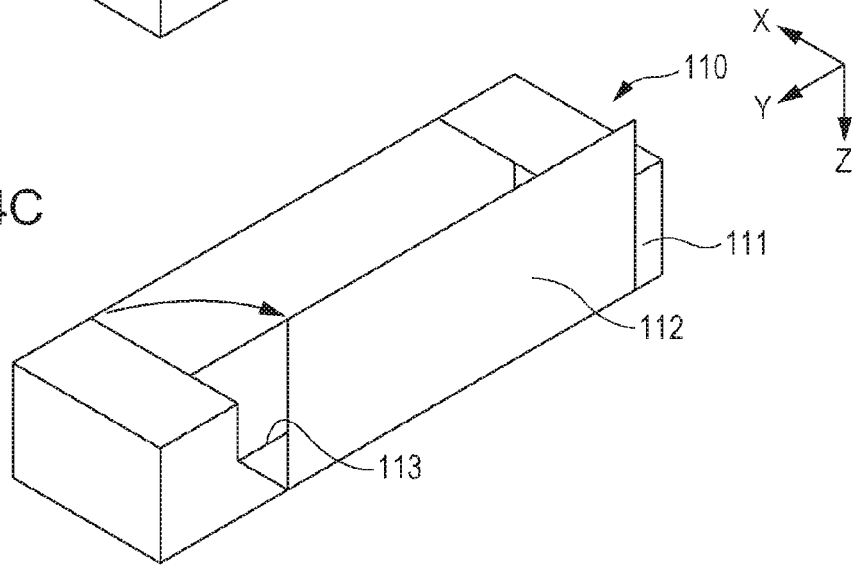

FIGS. 4A to 4C are each a perspective view of a housing 110 of the fold enhancing section 100. FIG. 4A is a top perspective view of the housing 110 in the "closed state". FIG. 4B is a bottom perspective view of the housing 100 in the "closed state". FIG. 4C is a bottom perspective view of the housing 110 in the "open state".

Figure 5:
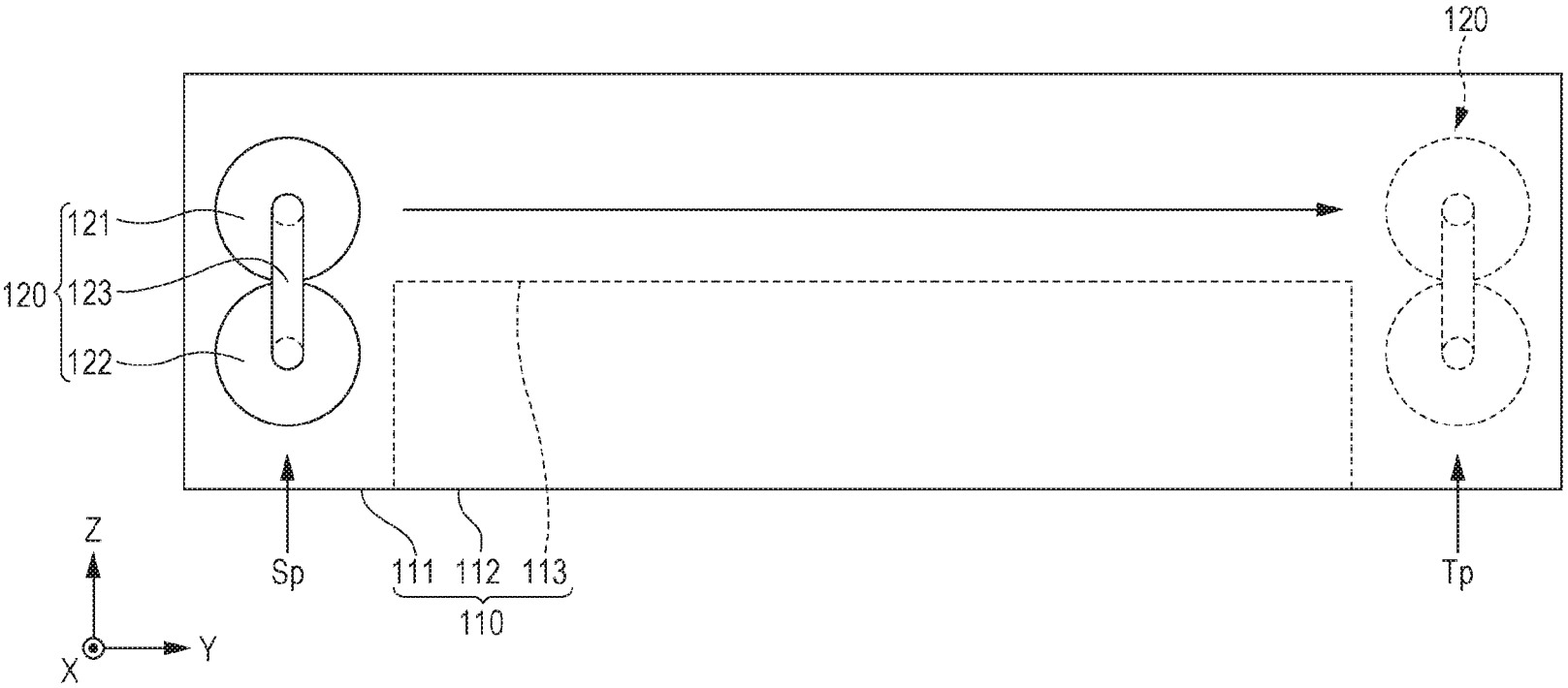
FIG. 5 is an explanatory view of a pressing mechanism of the fold enhancing section.

FIG. 5 is an explanatory view of the pressing mechanism 120 of the fold enhancing section 100. Here, FIG. 5 illustrates the interior of the fold enhancing section 100 in the "closed state" when viewed from the downstream side in the direction X.

Figure 6A:
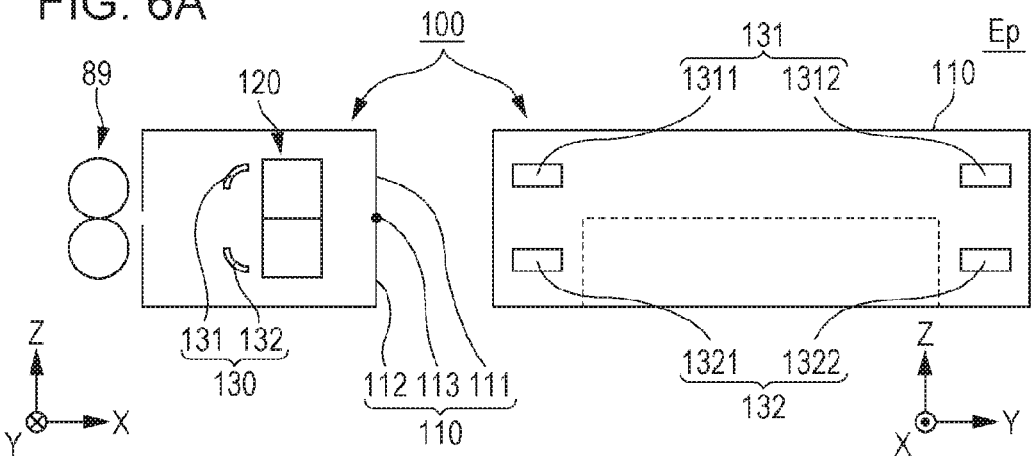
FIGS. 6A to 6C are each an explanatory view of a guiding mechanism of the fold enhancing section.
Figure 6B:
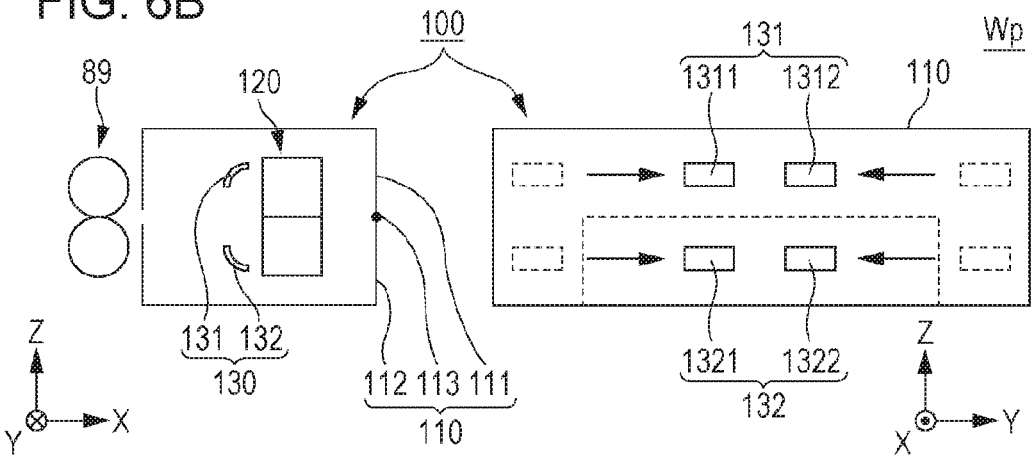
Figure 6C:
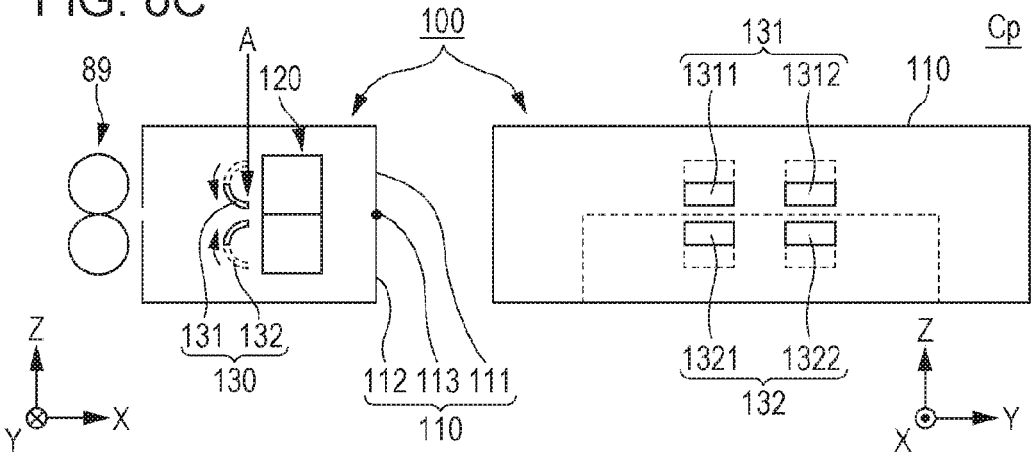

FIGS. 6A to 6C are each an explanatory view of a guiding mechanism 130 of the fold enhancing section 100. Here, FIG. 6A illustrates the guiding mechanism 130 disposed at a retreat position Ep. FIG. 6B illustrates the guiding mechanism 130 disposed at a standby position Wp. FIG. 6C illustrates the guiding mechanism 130 disposed at a nearby position Cp. FIGS. 6A to 6C also illustrate the fold enhancing section 100 when the fold enhancing section 100 is viewed from the near side (upstream side in the direction Y) (left illustrations in FIGS. 6A to 6C), and when the fold enhancing section 100 is viewed from the right side (downstream side in the direction X). FIGS. 6A to 6C also each illustrate the transport-out rollers 89 provided in the postprocessing unit 5 (the transport-out rollers 89 are only shown in the left illustrations in FIGS. 6A to 6C). The retreat position Ep, the standby position Wp, and the nearby position Cp are described below.

Figure 7:
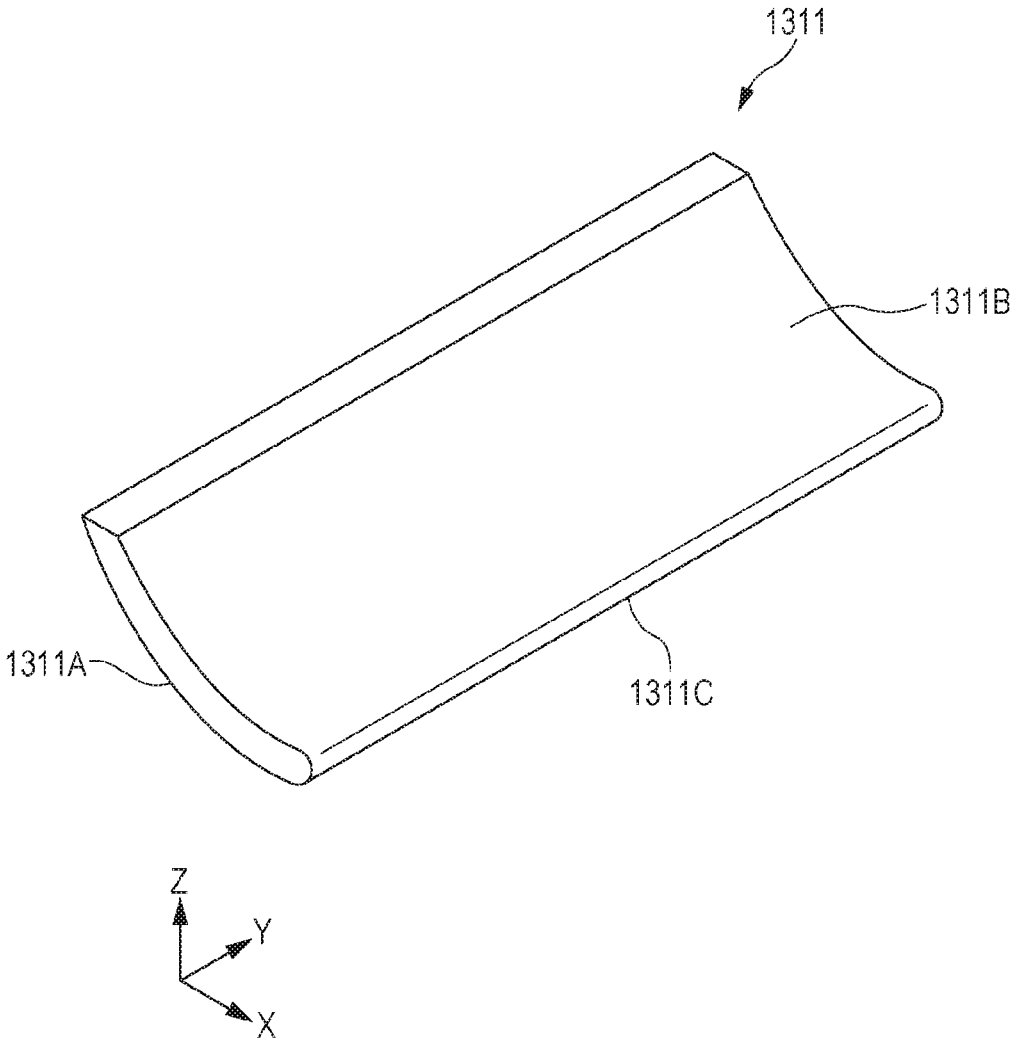
FIG. 7 is a perspective view of an upper first guiding plate of the guiding mechanism.

FIG. 7 is a perspective view of an upper first guide plate 1311 of the guiding mechanism 130.

In FIG. 5, the guiding mechanism 130 is not illustrated. In the right illustrations in FIGS. 6A to 6C, the pressing mechanism 120 is not illustrated. FIGS. 3A and 3B illustrate the state in which the guiding mechanism 130 is disposed at the retreat position Ep.

The fold enhancing section 100 includes the parallelepiped housing 110, the pressing mechanism 120, the guiding mechanism 130, an opening/closing detection sensor 140, and an entry detection sensor 150. The pressing mechanism 120 presses the vicinity of the central portion (saddle-stitched portion) of a booklet for performing a fold enhancing operation on the booklet. The guiding mechanism 130 guides the booklet that has been transported into the housing 110 towards the pressing mechanism 120. The opening/closing detection sensor 140 detects whether the housing 110 is set in the "open state" or in the "closed state". The entry detection sensor 150 detects entry of the booklet into the housing 110. Here, the pressing mechanism 120, the guiding mechanism 130, the opening/closing detection sensor 140, and the entry detection sensor 150 are disposed in the housing 110 in the "closed state".

First, the housing 110 includes a securing portion 111 that is secured to the postprocessing unit 5 when the housing 110 is mounted on the postprocessing unit 5, a movable portion 112 that is movable with respect to the securing portion 111, and a support shaft 113 that rotatably supports the movable portion 112 with respect to the securing portion 111.

The securing portion 111 has a parallelepiped shape, and has a structure in which a portion of an upstream-side (lower-side) surface thereof in the direction Z and a portion of a downstream-side surface thereof in the direction X are cut away. The movable portion 112 has an L shape in the XZ cross section, and is fitted to the cutaway portions of the securing portion 111. Further, the support shaft 113 is provided along the direction Y at a cutaway end portion of the downstream-side surface of the securing portion 111 in the direction X, and connects the movable portion 112 to the securing portion 111 such that the movable portion 112 is rotatable with respect to the securing portion 111.

By virtue of such a structure, the housing 110 according to the exemplary embodiment is set in the "closed state" in which the movable portion 112 is closed with respect to the securing portion 111 as shown in FIGS. 3A, 4A, and 4B; and is set in the "open state" in which the movable portion 112 is open with respect to the securing portion 111 as shown in FIGS. 3B and 4C. However, the phrase "closed state" according to the exemplary embodiments does not mean that, for example, the inside of the housing is hermetically sealed (is shut off) from the outside of the housing 110. Instead, the phrase "closed state" according to the exemplary embodiment means a state in which a person's hand (finger) is not capable of entering the housing 110 from the outside of the housing 110. Therefore, in the housing 110 in the "closed state", a gap of a size that does not allow a person's hand (finger) to enter the gap may be formed between the fixing portion 111 and the movable portion 112.

Next, the pressing mechanism 120, which is an example of a pressing section, includes a first pressing roller 121 (an example of a first opposing member) that is disposed in the housing 110, a second pressing roller 122 (an example of a second opposing member) that is disposed in the housing 110 and below the first pressing roller 121 (in the direction −Z), and a common shaft 123 that has a C shape and that rotatably supports both the first pressing roller 121 and the second pressing roller 122. By using the common shaft 121 in which a spring (not shown) is installed, the first pressing roller 121 and the second pressing roller 122 are disposed so as to contact each other without a booklet being nipped therebetween. The pressing mechanism 120 including the first pressing roller 121, the second pressing roller 122, and the common shaft 123 is mounted on the securing portion 111 of the housing 110. Therefore, the pressing mechanism 120 does not move together with the movable portion 112.

As illustrated in FIG. 5, the pressing mechanism 120 according to the exemplary embodiment is provided so as to move in the direction Y and the direction −Y in the housing 110. In the exemplary embodiment, the pressing mechanism 120 stops at an upstream-side end portion in the direction Y in the housing 110, and stops at a downstream-side end portion in the direction Y in the housing 110. In the description below, the position where the pressing mechanism 120 stops at the upstream-side end portion in the direction Y in the housing 110 is called a start position Sp, and the position where the pressing mechanism 120 stops at the downstream-side end portion in the direction Y in the housing 110 is called an end position Tp. The start position Sp is set upstream in the direction Y from an upstream-side end portion in the direction Y of the movable portion 112 of the housing 110. The end position Tp is set downstream in the direction Y from a downstream-side end portion in the direction Y of the movable portion 112 of the housing 110.

In the fold enhancing section 100 according to the exemplary embodiment, when the housing 110 is in the "open state", the pressing mechanism 120 is not allowed to move in the direction Y and in the direction −Y.

Next, the guiding mechanism 130, which is an example of a guiding section, includes an upper guiding portion 131 (an example of a first guiding member) that is disposed in the housing 110, and a lower guiding portion 132 (an example of a second guiding member) that is disposed in the housing 110 and below the upper guiding portion 131 (in the direction −Z). Of these, the upper guiding portion 131 includes an upper first guiding plate 1311 that is disposed at the upstream side in the direction Y and an upper second guiding plate 1312 that is disposed downstream from the upper first guiding plate 1311 in the direction Y. The lower guiding portion 132 includes a lower first guiding plate 1321 that is disposed at the upstream side in the direction Y and a lower second guiding plate 1322 that is disposed downstream from the lower first guiding plate 1321 in the direction Y. The guiding mechanism 130 including the upper guiding portion 131 and the lower guiding portion 132 is mounted on the securing portion 111 of the housing 110. Therefore, as with the above-described pressing mechanism 120, the guiding mechanism 130 does not move together with the movable portion 112.

In the guiding mechanism 130 according to the exemplary embodiment, as shown in FIGS. 6A to 6C, the upper first guiding plate 1311 and the upper second guiding plate 1312 of the upper guiding portion 131 are provided so as to move in the direction Y and in the direction −Y in the housing 110.

Of these, the upper first guiding plate 1311 stops at the upstream-side end portion in the direction Y in the housing 110 (called a "first position"; refer to FIG. 6A), and stops at a location that is closer to the downstream side in the direction Y in the housing 110 and that is in the vicinity of the central portion in the direction Y in the housing 110 or the movable portion 112 (called a "second position"; refer to FIG. 6B), the vicinity of the central portion being a portion that is situated upstream from the central portion in the direction Y). Further, the upper first guiding plate 1311 that is disposed at the second position is provided so as to rotate clockwise and counterclockwise around an axis extending in the direction Y. The upper first guiding plate 1311 stops at the second position, and rotates counterclockwise from the second position, so that the upper first guiding plate 1311 stops at an upstream side in the direction Z from the second position (that is, below the second position in the direction Z) and in the vicinity of a central portion in the direction Z in the housing 110 (called a "third position"; refer to FIG. 6C), the vicinity of the central portion being a portion that is situated downstream from the central portion in the direction Z (that is, above the central portion in the direction Z).

In contrast, the upper second guiding plate 1312 stops at the downstream-side end portion in the direction Y in the housing 110 (called a first position; refer to FIG. 6A), and stops at a location that is closer to the upstream side in the direction Y in the housing 110 and that is in the vicinity of the central portion in the direction Y in the housing 110 or the movable portion 112 (called a "second position"; refer to FIG. 6B), the vicinity of the central portion being a portion that is situated downstream from the central portion in the direction Y). Further, the upper second guiding plate 1312 disposed at the second position is provided so as to rotate clockwise and counterclockwise around the axis extending in the direction Y. The upper second guiding plate 1312 stops at the second position, and rotates counterclockwise from the second position, so that the upper second guiding plate 1312 stops at the upstream side in the direction Z from the second position (that is, below the second position in the direction Z) and in the vicinity of the central portion in the direction Z in the housing 110 (called a "third position"; refer to FIG. 6C), the vicinity of the central portion being a portion that is situated downstream from the central portion in the direction Z (that is, above the central portion in the direction Z).

In the guiding mechanism 130 according to the exemplary embodiment, as shown in FIGS. 6A to 6C, the lower first guiding plate 1321 and the lower second guiding plate 1322 of the lower guiding portion 132 are provided so as to move in the direction Y and in the direction −Y in the housing 110.

Of these, the lower first guiding plate 1321 stops at the upstream-side end portion in the direction Y in the housing 110 (called a "first position"; refer to FIG. 6A), and stops at a location that is closer to the downstream side in the direction Y in the housing 110 and that is in the vicinity of the central portion in the direction Y in the housing 110 or the movable portion 112 (called a "second position"; refer to FIG. 6B), the vicinity of the central portion being a portion that is situated upstream from the central portion in the direction Y). Further, the lower first guiding plate 1321 that is disposed at the second position is provided so as to rotate clockwise and counterclockwise around the axis extending in the direction Y. The lower first guiding plate 1321 stops at the second position, and rotates clockwise from the second position, so that the lower first guiding plate 1321 stops at a downstream side in the direction Z from the second position (that is, above the second position in the direction Z) and in the vicinity of the central portion in the direction Z in the housing 110 (called a "third position"; refer to FIG. 6C), the vicinity of the central portion being a portion that is situated upstream from the central portion in the direction Z (that is, below the central portion in the direction Z).

In contrast, the lower second guiding plate 1322 stops at the downstream-side end portion in the direction Y in the housing 110 (called a first position; refer to FIG. 6A), and stops at a location that is closer to the upstream side in the direction Y in the housing 110 and that is in the vicinity of the central portion in the direction Y in the housing 110 or the movable portion 112 (called a "second position"; refer to FIG. 6B), the vicinity of the central portion being a portion that is situated downstream from the central portion in the direction Y). Further, the lower second guiding plate 1322 disposed at the second position is provided so as to rotate clockwise and counterclockwise around the axis extending in the direction Y. The lower second guiding plate 1322 stops at the second position, and rotates clockwise from the second position, so that the lower second guiding plate 1322 stops at the downstream side in the direction Z from the second position (that is, above the second position in the direction Z) and in the vicinity of the central portion in the direction Z in the housing 110 (called a "third position"; refer to FIG. 6C), the vicinity of the central portion being a portion that is situated upstream from the central portion in the direction Z (that is, below the central portion in the direction Z).

Here, the first position of the upper first guiding plate 1311 and the first position of the lower first guiding plate 1321 are set at the upstream side in the Y direction from the upstream-side end portion in the direction Y from the movable portion 112 of the housing 110. The first position of the upper second guiding plate 1312 and the first position of the lower second guiding plate 1322 are set at the downstream side in the direction Y from the downstream-side end portion in the direction Y of the movable portion 112 of the housing 110. In contrast, the second and third positions of the upper first guiding plate 1311, the second and third positions of the upper second guiding plate 1312, the second and third positions of the lower first guiding plate 1321, and the second and third positions of the lower second guiding plate 1322 are set at the downstream side in the direction Y from the upstream-side end portion in the direction Y of the movable portion 112 of the housing 110 and at the upstream side in the direction Y from the downstream-side end portion in the direction Y of the movable portion 112 of the housing 110.

In the exemplary embodiment, the state in which the upper first guiding plate 1311, the upper second guiding plate 1312, the lower first guiding plate 1321, and the lower second guiding plate 1322 are disposed at their respective first positions as shown in FIG. 6A is called a "state in which the guiding mechanism 130 is disposed at the retreat position Ep". In the exemplary embodiment, the state in which the upper first guiding plate 1311, the upper second guiding plate 1312, the lower first guiding plate 1321, and the lower second guiding plate 1322 are disposed at their respective second positions as shown in FIG. 6B is called a "state in which the guiding mechanism 130 is disposed at the standby position Wp". Further, in the exemplary embodiment, the state in which the upper first guiding plate 1311, the upper second guiding plate 1312, the lower first guiding plate 1321, and the lower second guiding plate 1322 are disposed at their respective third positions as shown in FIG. 6C is called a "state in which the guiding mechanism 130 is disposed at the nearby position Cp".

Here, the position where, with the guiding mechanism 130 being set at the nearby position Cp as shown in FIG. 6C, a downstream-side end portion in the direction X of the upper guiding portion 131 (that is, the upper first guiding plate 1311 and the upper second guiding plate 1312) and a downstream-side end portion in the direction X of the lower guiding portion 132 (the lower first guiding plate 1321 and the lower second guiding plate 1322) ((end portion 1311C (described below); see FIG. 7) are disposed is called a front end position A.

In the fold enhancing section 100 according to the exemplary embodiment, when the housing 110 is in the "open state", the guiding mechanism 130 is not allowed to move.

Here, the upper first guiding member 1311 shown in FIG. 7 includes a facing surface 1311A that, by facing downward, faces an upper surface of a booklet that has been transported into the housing 110, and a non-facing surface 1311B that corresponds to a lower surface of the facing surface 1311A. The upper first guiding plate 1311 has a curved shape, with the facing surface 1311A being a convex surface and the non-facing surface 1311B being a concave surface. The end surface 1311C, which is an end portion that contacts the booklet, of the upper first guiding plate 1311 is chamfered. The end portion 1311C has a round cross-sectional shape. The upper first guiding plate 1311 need not be formed as a complete plate. The upper first guiding plate 1311 may have, for example, an opening or a cutaway portion as long as they do not constitute a hindrance to the guiding of the booklet.

The upper second guiding plate 1312, the lower first guiding plate 1321, and the lower second guiding plate 1322 also have the same structure as the above-described upper first guiding plate 1311. However, as with the upper first guiding plate 1311, the facing surface 1311A of the upper second guiding plate 1312 faces the upper surface of the booklet, whereas the facing surface 1311A of the lower first guiding plate 1321 and the facing surface 1311A of the lower second guiding plate 1322 face the lower surface of the booklet.

The opening/closing detection sensor 140 detects whether the movable portion 112 is open or closed with respect to the securing portion 111 of the housing 110. In the exemplary embodiment, when the state of the housing 110 in the "open state" is being changed to the "closed state", the opening/closing detection sensor 140 detects that the housing 110 is in the "closed state" after a gap between the securing portion 111 and the movable portion 112 has been narrowed to at least a size that does not allow a person's hand (finger) to enter the gap. In the exemplary embodiment, when the state of the housing 110 in the "closed state" is being changed to the "open state", the opening/closing detection sensor 140 detects that the housing 110 is in the "open state" after the gap formed between the securing portion 111 and the movable portion 112 has been widened to a size that does not constitute a hindrance to the discharge of the booklet.

Further, the entry detection sensor 150 detects the entry of the booklet that has been transported into the housing 110 by, for example, the transport-out rollers 89. Here, the entry detection sensor 150 according to the exemplary embodiment is mounted in the housing 110, and upstream from the guiding mechanism 130 in the direction X.

The opening/closing detection sensor 140 and the entry detection sensor 150 are mounted on the securing portion 111 of the housing 110. Therefore, the opening/closing detection sensor 140 and the entry detection sensor 150 do not move together with the movable portion 112.

Structure of Control System

Figure 8:
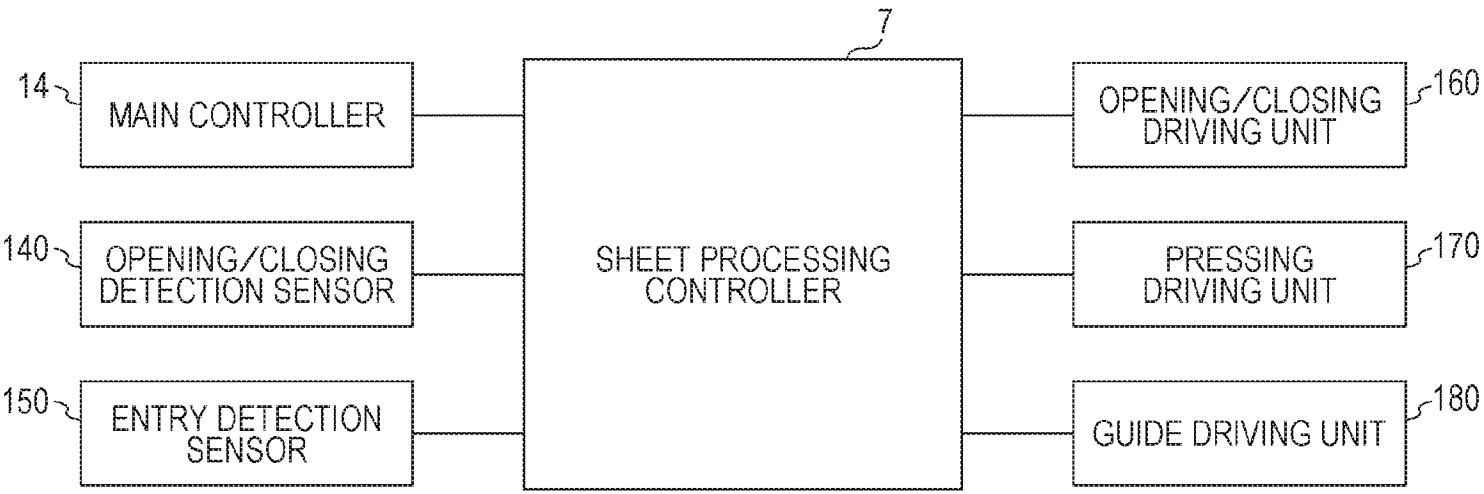
FIG. 8 is a block diagram regarding control of the fold enhancing section.

FIG. 8 is a block diagram regarding control of the fold enhancing section 100 according to the exemplary embodiment.

A control signal from the main controller 14, an opening/closing detection signal from the opening/closing detection sensor 140, and an entry detection signal from the entry detection sensor 150 are input to the sheet processing controller 7 that directly controls the operation of the fold enhancing section 100. The sheet processing controller 7 outputs control signals to an opening/closing driving unit 160 that performs driving for opening and closing the movable portion 112 with respect to the securing portion 111, a pressing driving unit 170 that performs driving for moving the pressing mechanism 120 between the start position Sp and the end position Tp, and a guiding driving unit 180 that performs driving for moving the guiding mechanism 130 between the retreat position Ep and the standby position Wp, and between the standby position Wp and the nearby position Cp. In this exemplary embodiment, the opening/closing driving unit 160, the pressing driving unit 170, and the guiding driving unit 180 are built in the housing 110 of the fold enhancing section 100.

Operation of Fold Enhancing Section

FIGS. 9A to 12B illustrate operations of the fold enhancing section 100 according to the exemplary embodiment. FIGS. 9A to 12B illustrate the fold enhancing section 100 when the fold enhancing section 100 is viewed from the near side (upstream side in the direction Y)(left illustrations in FIGS. 9A to 12B) and from the right side in FIGS. 9A to 12B (downstream side in the direction X)(right illustrations in FIGS. 9A to 12B). FIGS. 9A to 12B also each illustrate the transport-out rollers 89 provided in the postprocessing unit 5 (the transport-out rollers 89 are only shown in the left illustrations in FIGS. 9A to 12B).

(a) First Preparation for Transport-in Operation

Figure 9A:
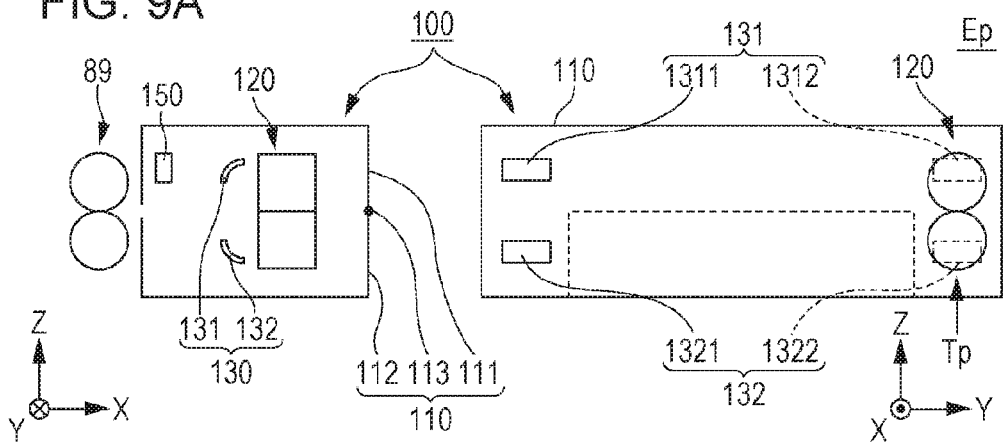
FIGS. 9A to 9C illustrate operations of the fold enhancing section.

FIG. 9A illustrates a "first preparation for transport-in operation" step in which the fold enhancing section 100 prepares for a transport-in operation for transporting a booklet B (see FIG. 9C below) into the fold enhancing section 100 by using the transport-out rollers 89. At this time, rotational driving of the transport-out rollers 89 is stopped. In addition, at this time, in the fold enhancing section 100, the housing 110 is in the "closed state". Further, at this time, the pressing mechanism 120 is disposed at the end position Tp. Still further, at this time, the guiding mechanism 130 is disposed at the retreat position Ep.

(b) Second Preparation for Transport-in Operation

Figure 9B:
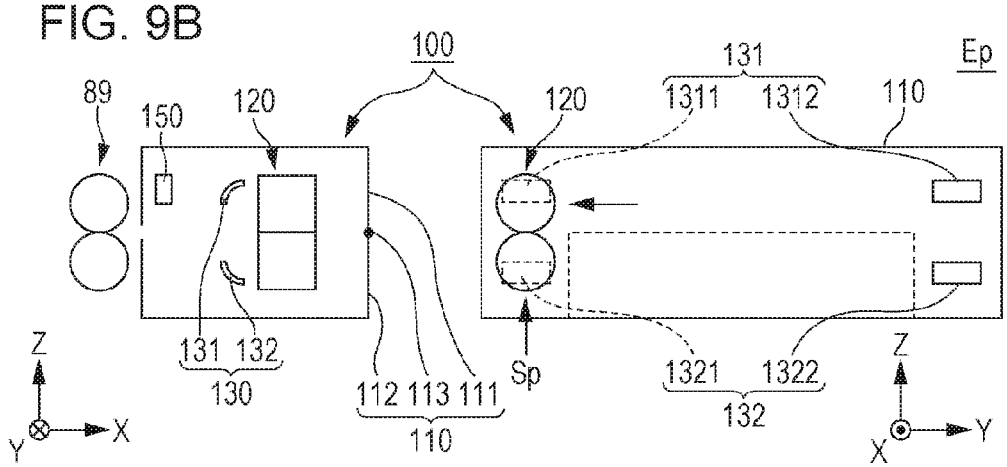

FIG. 9B illustrates a "second preparation for transport-in operation" step in which, after the above-described "first preparation for transport-in operation" step, the fold enhancing section 100 continues preparing for the transport-in operation for transporting the booklet B into the fold enhancing section 100 by using the transport-out rollers 89. At this time, the rotational driving of the transport-out rollers 89 is still stopped. In addition, at this time, in the fold enhancing section 100, the housing 110 is kept in the "closed state". Further, at this time, the guiding mechanism 130 continues to be disposed at the retreat position Ep. Still further, in this state, the pressing mechanism 120 moves from the end position Tp shown in FIG. 9A to the start position Sp. At this time, since the booklet B has not been transported into the fold enhancing section 100, the pressing mechanism 120 moves from the end position Tp to the start position Sp without nipping the booklet B.

(c) Start of Transport-in Operation

Figure 9C:
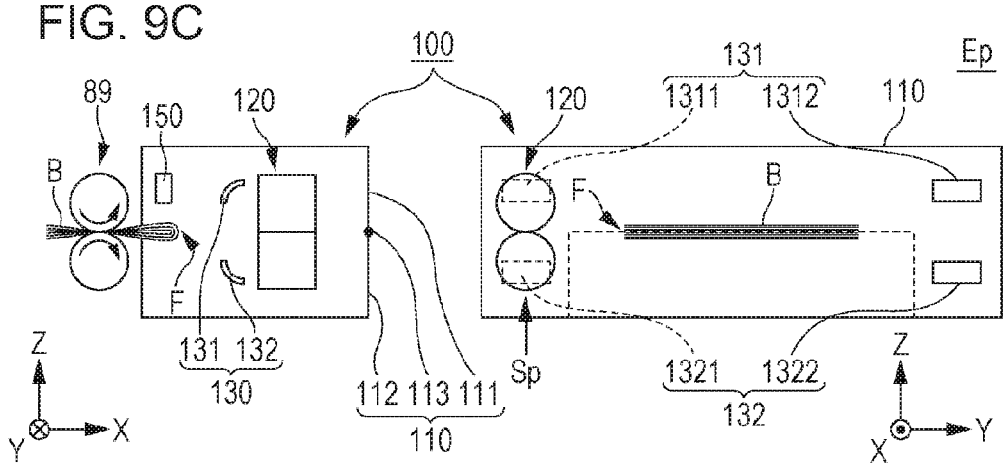

FIG. 9C illustrates a "start of transport-in operation" step in which, after the above-described "second preparation for transport-in operation" step, the transporting of the booklet B into the fold enhancing section 100 by the transport-out rollers 89 is started. At this time, in the fold enhancing section 100, the housing 110 is kept in the "closed state". In addition, at this time, the pressing mechanism 120 continues to be disposed at the start position Sp. Further, at this time, the guiding mechanism 130 continues to be disposed at the retreat position Ep. Still further, in this state, the state of the transport rollers 89 is changed from the state shown in FIG. 9B in which the rotationally driving is stopped to a state in which the transport rollers 89 are rotationally driven, so that, with a saddle-stitched portion F (example of a folded portion) being a leading end, the booklet B is nipped and transported by the transport-out rollers 89, and the booklet B enters the housing 110 in the direction X. Then, when the saddle-stitched portion F of the booklet B that is being transported reaches a location opposing the entry detection sensor 150, the entry of the booklet B into the housing 110 is detected.

(d) Preparation for Guiding Operation

Figure 10A:
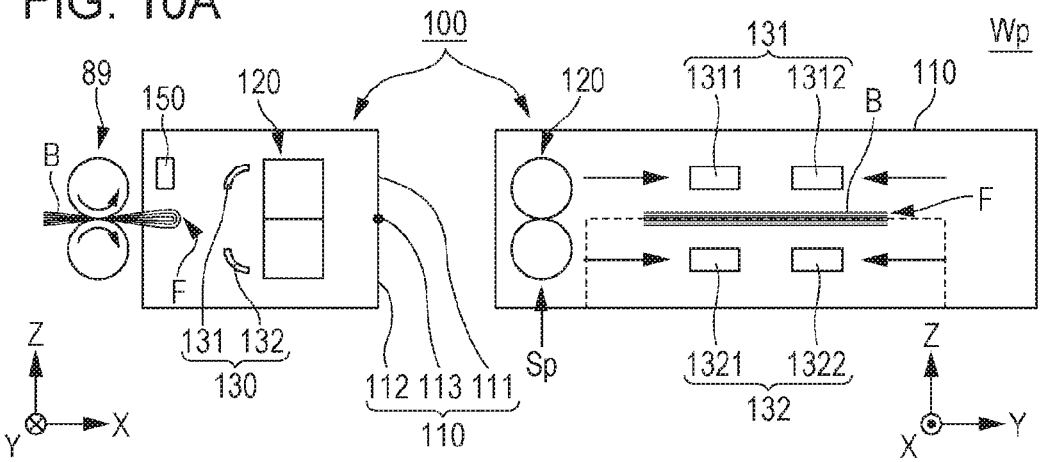
FIGS. 10A to 10C illustrate subsequent operations of the fold enhancing section.

FIG. 10A illustrates a "preparation for guiding operation" step in which, after the above-described "start of transport-in operation" step, the fold enhancing section 100 prepares for the guiding operation for guiding the booklet B by using the guiding mechanism 130. At this time, the transport-out rollers 89 continue to be rotationally driven, and the booklet B is transported in the direction X with the saddle-stitched portion F being the leading end. At this time, in the fold enhancing section 100, the housing 110 is kept in the "closed state". In addition, at this time, the pressing roller 120 continues to be disposed at the start position Sp. Then, after the entry detection sensor 150 has detected the booklet B, the guiding mechanism 130 moves from the retreat position Ep shown in FIG. 9C to the standby position Wp before the saddle-stitched portion F, which is the leading end of the booklet B in the transport direction, reaches the front end position A (see FIG. 6C).

(e) Booklet Guiding

Figure 10B:
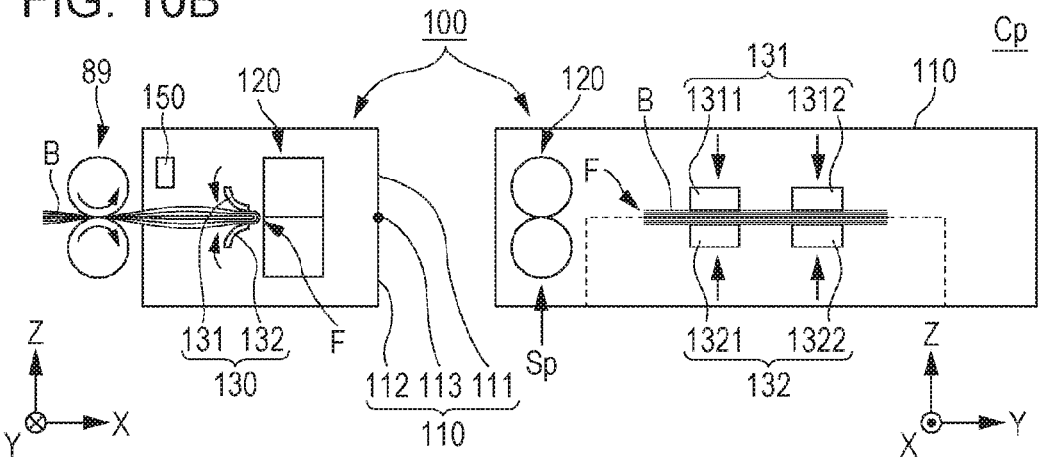

FIG. 10B illustrates a "booklet guiding" step in which, after the above-described "preparation for guiding operation" step, the booklet B is guided by the guiding mechanism 130. At this time, the transport-out rollers 89 continue to be rotationally driven, and the booklet B is transported in the direction X with the saddle-stitched portion F being the leading end. At this time, in the fold enhancing section 100, the housing 110 is kept in the "closed state". In addition, at this time, the pressing roller 120 continues to be disposed at the start position Sp. Then, in this state, after the saddle-stitched portion F, which is the leading end of the booklet B in the transport direction, has passed the front end position A (see FIG. 6C) and before the saddle-stitched portion F reaches a movement path of the pressing mechanism 120 (path from the start position Sp to the end position Tp), the guiding mechanism 130 moves from the standby position Wp shown in FIG. 10A to the nearby position Cp.

At this time, the upper first guiding plate 1311, the upper second guiding plate 1312, the lower first guiding plate 1321, and the lower second guiding plate 1322 of the guiding mechanism 130 move from the standby position Wp to the nearby position Cp to nip the booklet B that is being transported from above and below the booklet B. At this time, the upper first guiding plate 1311, the upper second guiding plate 1312, the lower first guiding plate 1321, and the lower second guiding plate 1322 move in the direction X, which is the same as the transport direction of the booklet B, when they approach the nearby position Cp. Therefore, the transport of the booklet B is less likely to be hindered thereby. In addition, at this time, when the upper first guiding plate 1311, the upper second guiding plate 1312, the lower first guiding plate 1321, and the lower second guiding plate 1322 are in a state in which they have reached the nearby position Cp, they nip portions of the booklet B being transported situated behind the saddle-stitched portion F of the booklet B. Here, the booklet B that is being transported into the fold enhancing section 100 (housing 110) is nipped by the transport-out rollers 89 before the booklet B is transported into the fold enhancing section 100, so that the booklet B is in a state in which a fold line of the saddle-stitched portion F is squeezed. However, the booklet B that has been transported into the fold enhancing section 100 tries to return to its original state due to good strong sheets P that make up the booklet B, so that the saddle-stitched portion F gradually expands. Therefore, if the guiding mechanism 130 is disposed at the nearby position Cp before the saddle-stitched portion F reaches the front end position A, the booklet B may not be capable of passing through a gap formed between the upper guiding portion 131 and the lower guiding portion 132 at the nearby position Cp. In contrast, in the exemplary embodiment, since the guiding mechanism 130 is disposed at the nearby position Cp after the saddle-stitched portion F has passed the front end position A, the transport of the booklet B is less likely to be hindered by the guiding mechanism 130 disposed at the nearby position Cp.

(f) Transport-in Operation Stoppage

Figure 10C:
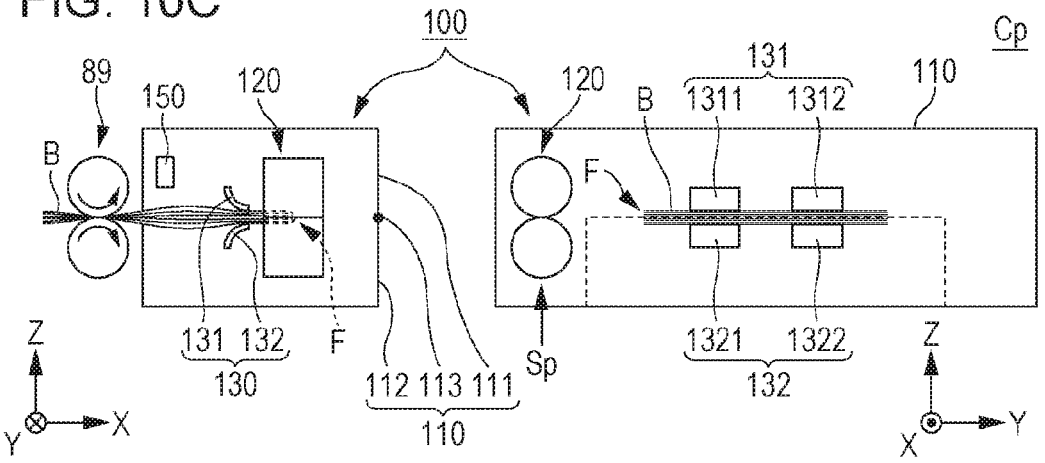

FIG. 10C illustrates a "transport-in operation stoppage" step in which, after the above-described "booklet guiding" step, the transporting of the booklet B into the fold enhancing section 100 by the transport-out rollers 89 is stopped. At this time, in the fold enhancing section 100, the housing 110 is kept in the "closed state". In addition, at this time, the pressing mechanism 120 continues to be disposed at the start position Sp. Further, the guiding mechanism 130 continues to be disposed at the nearby position Cp. Then, in this state, the state of the transport-out rollers 89 is changed from the state in which the transport-out rollers 89 are rotationally driven shown in FIG. 10B to the state in which the rotational driving of the transport-out rollers 89 is stopped. More specifically, with the saddle-stitched portion F having reached the movement path of the pressing mechanism 120 (path extending from the start position Sp to the end position Tp), the rotational driving of the transport-out rollers 89 is stopped. Here, with the "transport-in operation stoppage"

step having ended, the transport-out rollers 89 whose rotationally driving has been stopped nips and fixes the booklet B.

(g) Pressing Operation

Figure 11A:
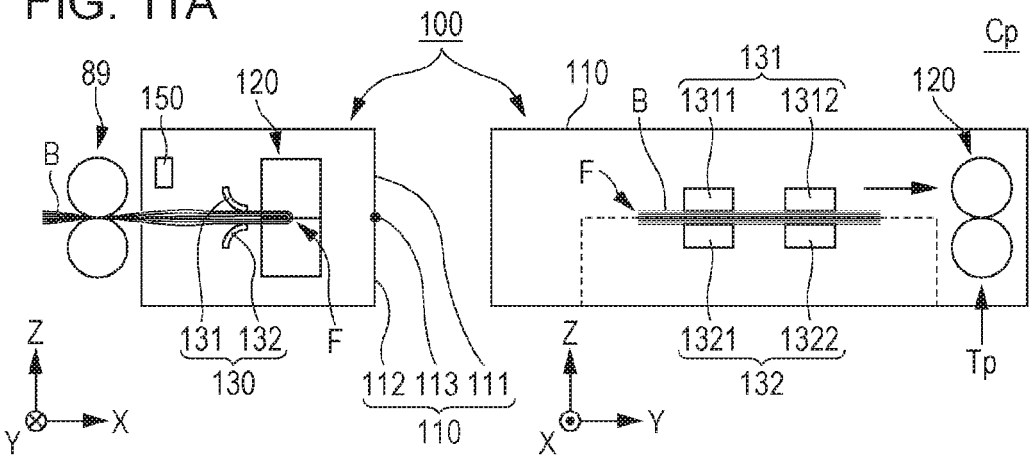
FIGS. 11A to 11C illustrate subsequent operations of the fold enhancing section.

FIG. 11A illustrates a "pressing operation" step in which, after the above-described "transport-in operation stoppage" step, by moving the pressing mechanism 120 (the first pressing roller 121 and the second pressing roller 122) in the direction Y, the vicinity of the saddle-stitched portion F of the booklet B is pressed (subjected to a fold enhancing operation). At this time, the rotational driving of the transport rollers 89 is still stopped. In addition, at this time, in the fold enhancing section 100, the housing 110 is kept in the "closed state". Further, at this time, the guiding mechanism 130 continues to be disposed at the nearby position Cp. Then, in this state, the pressing mechanism 120 moves from the start position Sp shown in FIG. 10C to the end position Tp. More specifically, in the "pressing operation" step, the first pressing roller 121 and the second pressing roller 122 that move in the direction Y move from the start position Sp where they do not nip the saddle-stitched portion F of the booklet B to a position where they nip the saddle-stitched portion F, so that the pressing (fold enhancing) is performed along the saddle-stitched portion F. By moving over and beyond the saddle-stitched portion F, the state of the first pressing roller 121 and the second pressing roller 122 is changed again to the state in which they do not nip the saddle-stitched portion F, and the first pressing roller 121 and the second pressing roller 122 reach and stop at the end position Tp. Here, in a state in which the "pressing operation" step has ended, the second pressing roller 122 of the pressing mechanism 120 no longer exists directly below the booklet B fixed by the transport-out rollers 89.

(h) First Preparation for Discharge

Figure 11B:
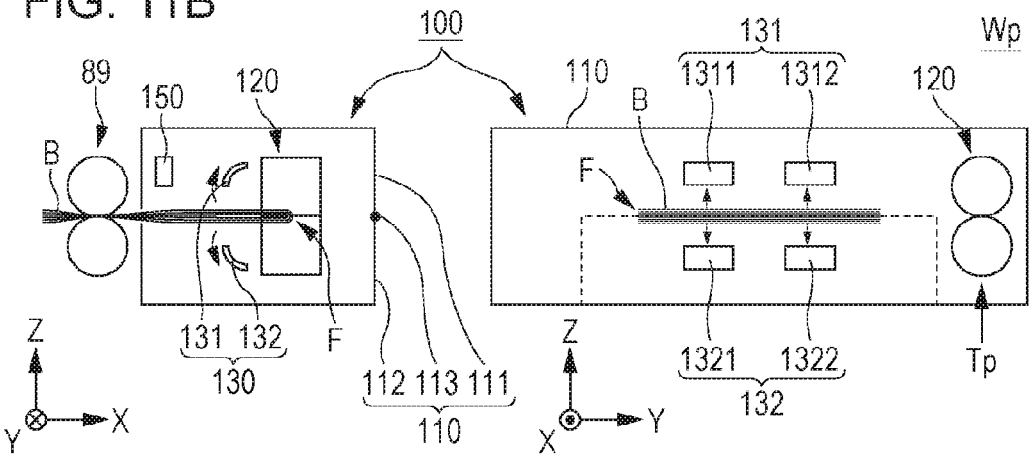

FIG. 11B illustrates a "first preparation for discharge" step in which, after the above-described "pressing operation" step, the fold enhancing section 100 prepares for discharge of the booklet B on which the fold enhancing operation has been performed to the booklet placement section 90. At this time, the rotational driving of the transport-out rollers 89 is still stopped. In addition, at this time, in the fold enhancing section 100, the housing 110 is kept in the "closed state". Further, at this time, the pressing mechanism 120 continues to be disposed at the end position Tp. Then, in this state, the guiding mechanism 130 moves from the nearby position Cp shown in FIG. 11A to the standby position Wp.

(i) Second Preparation for Discharge

Figure 11C:
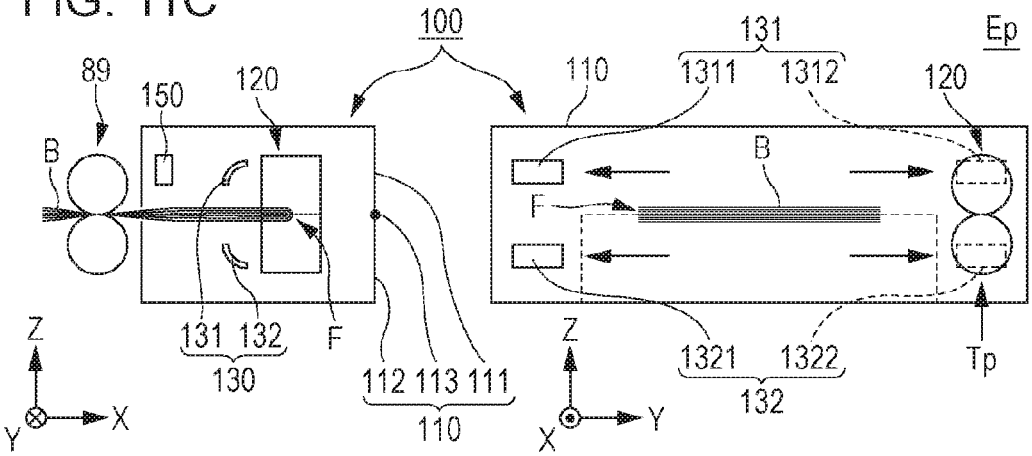

FIG. 11C illustrates a "second preparation for discharge" step in which, after the above-described "first preparation for discharge" step, the fold enhancing section 100 continues preparing for the discharge of the booklet B on which the fold enhancing operation has been performed to the booklet placement section 90. At this time, the rotational driving of the transport-out rollers 89 is still stopped. In addition, at this time, in the fold enhancing section 100, the housing 110 is kept in the "closed state". Further, at this time, the pressing mechanism 120 continues to be disposed at the end position Tp. Then, in this state, the guiding mechanism 130 moves from the standby position Wp shown in FIG. 11B to the retreat position Ep.

(j) Third Preparation for Discharge

Figure 12A:
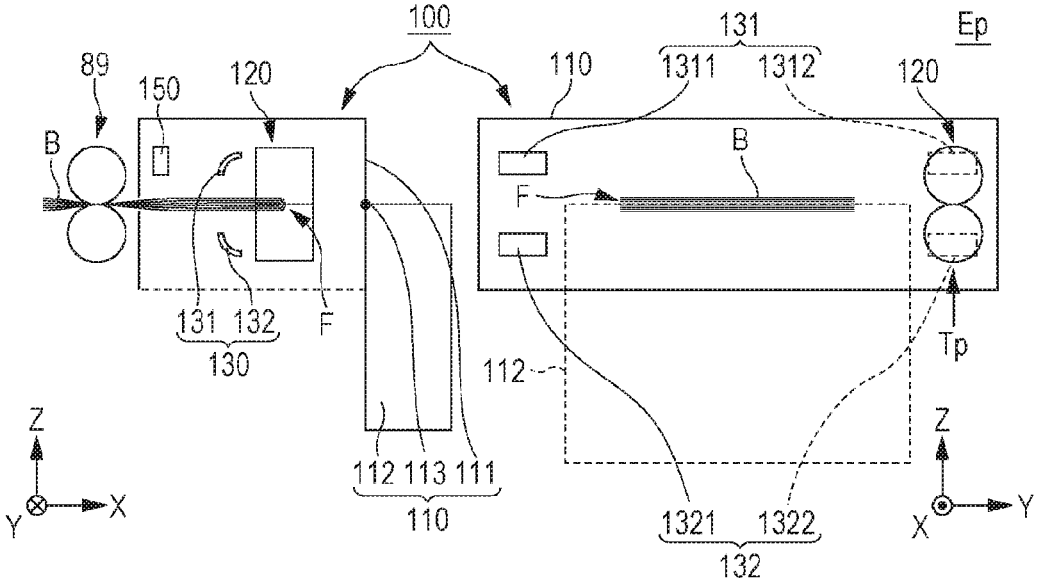
FIGS. 12A and 12B illustrate subsequent operations of the fold enhancing section.

FIG. 12A illustrates a "third preparation for discharge" step in which, after the above-described "second preparation for discharge" step, the fold enhancing section 100 continues preparing for the discharge of the booklet B on which the fold enhancing operation has been performed to the booklet placement section 90. At this time, the rotational driving of the transport-out rollers 89 is still stopped. In addition, at this time, the pressing mechanism 120 continues to be disposed at the end position Tp. Further, at this time, the guiding mechanism 130 continues to be disposed at the retreat position Ep. Then, in this state, the state of the housing 110 is changed from the "closed state" shown in FIG. 11C to the "open state". Here, with the "third preparation for discharge" step having ended, the movable portion 112 of the housing 110 as well as the second pressing roller 122 of the pressing mechanism 120 no longer exists directly below the booklet B fixed by the transport-out rollers 89.

(k) Booklet Discharge

Figure 12B:
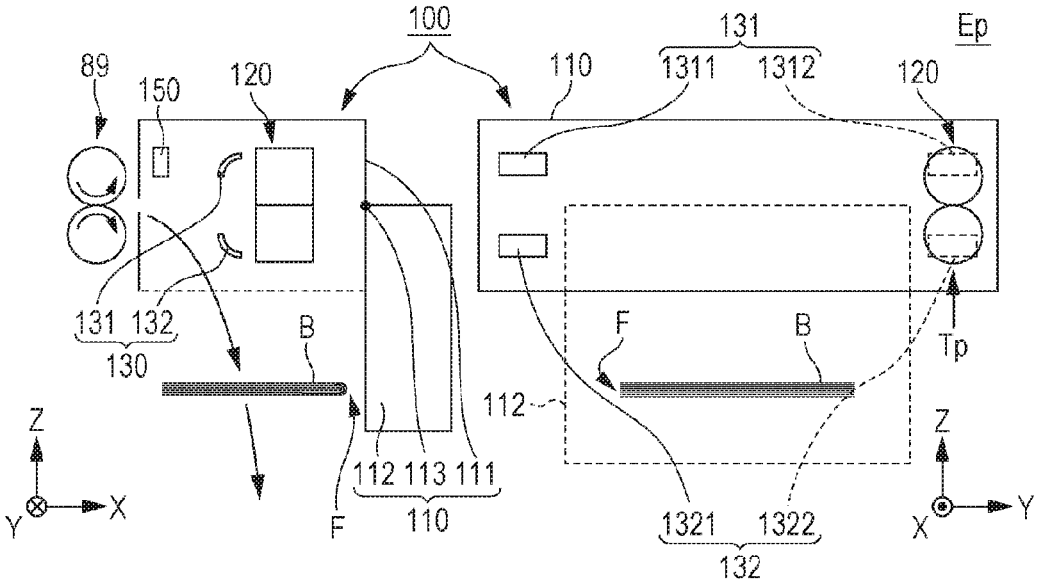

FIG. 12B illustrates a "booklet discharge" step in which, after the above-described "preparation for discharge" steps, the booklet B is discharged to the booklet placement section 90 from the fold enhancing section 100 by the transport-out rollers 89. At this time, in the fold enhancing section 100, the housing 110 is kept in the "open state". In addition, at this time, the pressing mechanism 120 continues to be disposed at the end position Tp. Further, at this time, the guiding mechanism 130 continues to be disposed at the retreat position Ep. Then, in this state, the state of the transport rollers 89 is changed from the state shown in FIG. 12A in which the rotationally driving is stopped to the state in which the transport rollers 89 are rotationally driven, so that the booklet B is nipped and transported with the saddle-stitched portion F being the leading end. Then, as the booklet B is transported, the booklet B that is no longer nipped by the transport-out rollers 89 falls vertically downward (upstream side in the direction Z) due to gravity. At this time, the booklet B falls without being hindered by the movable portion 112 of the housing 110 and the second pressing roller 122 of the pressing mechanism 120, and is placed on the placement table 91 of the booklet placement section 90. Here, although, as shown in, for example, FIGS. 4A to 4C, the securing portion 111 exists on both ends of the lower surface of the housing 110 in the axial direction (direction Y), the falling of the booklet B is not hindered because the securing portion 111 is positioned at the outer sides of the booklet B that falls.

After the above-described "booklet discharge" step (after at least a trailing end portion of the booklet B (end portion opposite to the saddle-stitched portion F) has passed between the transport-out rollers 89), the rotational driving of the transport-out rollers 89 is stopped, and the state of the housing 110 is changed from the "open state" to the "closed state", so that the fold enhancing section 100 proceeds to the "first preparation for transport-in operation" step shown in FIG. 9A. Then, by repeating the steps from the above-described "first preparation for transport-in operation" step in (a) to the "booklet discharge" step in (k), fold enhancing operations are performed on booklets B that are being transported into the fold enhancing section 100.

Modification

Although, in the above-described exemplary embodiment, the pressing mechanism 120 is one that presses the upper surface and the lower surface of the booklet B and that performs the fold enhancing operation on the saddle-stitched portion F of the booklet B, other types may be used.

Figure 13C:
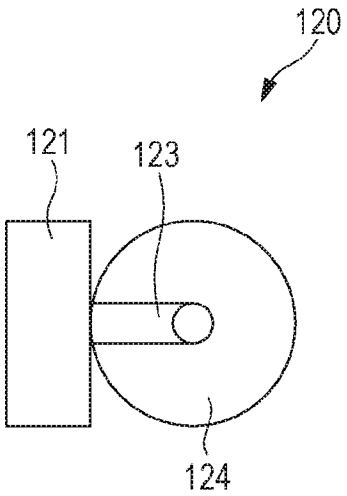
FIGS. 13A to 13C are each an explanatory view of another structure of the pressing mechanism.
Figure 13B:
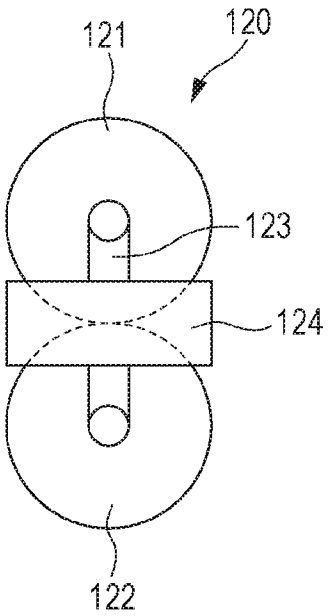
Figure 13A:
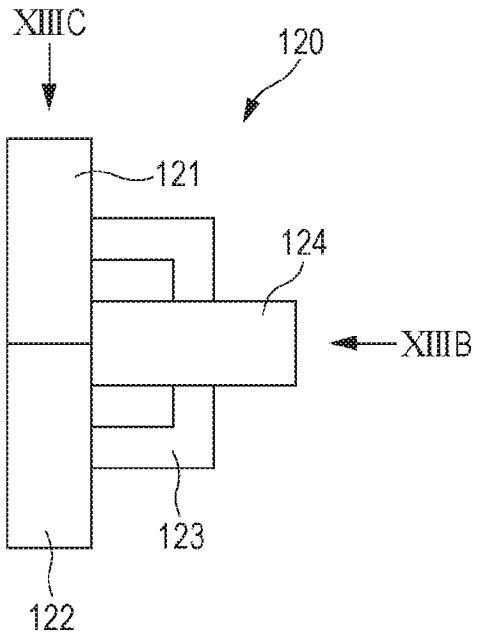

FIGS. 13A to 13C are each an explanatory view of another structure of the pressing mechanism 120. Here, FIG. 13A illustrates the pressing mechanism 120 when viewed from the near side (upstream side in the direction Y in FIG. 1). FIG. 13B illustrates the pressing mechanism 120 when viewed from the direction of arrow XIIIB shown in FIG. 13A. FIG. 13C illustrates the pressing mechanism 120 when viewed from the direction of arrow XIIIC shown in FIG.

13A. The pressing mechanism 120 shown in FIGS. 13A to 13C is used when performing square-back binding in which the saddle-stitched portion F that connects the upper surface and the lower surface of the booklet B is also provided with a surface (back surface). In addition to the above-described first pressing roller 121, second pressing roller 122, and common shaft 123, the pressing mechanism 120 shown in FIGS. 13A to 13C further includes a back-surface pressing roller 124 that presses the saddle-stitched portion F of the booklet B from a side thereof and provides the booklet B with the back surface. When the pressing mechanism 120 shown in FIGS. 13A to 13C moves from the start position Sp to the end position Tp (for both of these positions, see FIG. 5), a fold enhancing operation is performed on the saddle-stitched portion F of the booklet B, and the saddle-stitched portion F having the back surface is formed.

Although, in the exemplary embodiment, the upper guiding portion 131 and the lower guiding portion 132 of the guiding mechanism 130 are both movable, the structure of the guiding mechanism 130 is not limited thereto. For example, it is possible for the upper guiding portion 131 to be fixed at the nearby position Cp, and the lower guiding portion 132 to move between the retreat position Ep and the standby position Wp, and between the standby position Wp and the nearby position Cp.

Although, in the exemplary embodiment, the guiding mechanism 130 is provided in the fold enhancing section 100, the location where the guiding mechanism 130 is provided is not limited thereto. For example, the guiding mechanism 130 may be provided at the side of the postprocessing unit 5 on which the fold enhancing section 100 is mounted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A folding processing device comprising:

a pressing section that includes a first member opposing a folded portion of a folded sheet, the pressing section pressing the folded portion; and a guiding section having a curved shape that is disposed upstream from the pressing section in a sheet transport direction, the guiding section nipping the sheet whose folded portion has passed through the guiding section and guiding the sheet to the pressing section while remaining stationary to permit the sheet to slide through the guide section.

2. The folding processing device according to claim 1, wherein the guiding section includes a first guiding member and a second guiding member that oppose each other with a sheet transport path interposed therebetween, and wherein, after the folded portion has passed between an opposing portion of the first guiding member and an opposing portion of the second guiding member, the first guiding member and the second guiding member are closer to each other than before the folded portion passes between the opposing portions.

3. The folding processing device according to claim 2, wherein the first guiding member and the second guiding member move in the sheet transport direction when the first guiding member and the second guiding member move closer to each other.

4. The folding processing device according to claim 3, wherein the second guiding member is disposed below the first guiding member, and wherein the second guiding member retreats from below the sheet after the pressing section has pressed the folded portion.

5. The folding processing device according to claim 2, wherein the second guiding member is disposed below the first guiding member, and wherein the second guiding member retreats from below the sheet after the pressing section has pressed the folded portion.

6. The folding processing device according to claim 1, wherein the first opposing member and the second opposing member are rollers.

7. The folding processing device according to claim 1, wherein a lower surface of the guiding section is configured to move perpendicular with respect to the sheet transport direction to permit the folded sheet to drop below the transport path.

8. A sheet processing device comprising:

a folding processing section that performs a folding operation on a sheet and forms a folded portion;

a pressing section that is disposed downstream from the folding processing section in a sheet transport direction, the pressing section including a first member that opposes the folded portion of the sheet that has been folded by the folding processing section, the pressing section pressing the folded portion; and a guiding section having a curved shape that is disposed downstream from the folding processing section in the sheet transport direction and upstream from the pressing section in the sheet transport direction, the guiding section nipping the sheet whose folded portion has passed through the guiding section and guiding the sheet to the pressing section while remaining stationary to permit the sheet to slide through the guide section.

9. The sheet processing device according to claim 8, wherein the first opposing member and the second opposing member are rollers.

10. The sheet processing device according to claim 8, wherein a lower surface of the guiding section is configured to move perpendicular with respect to the sheet transport direction to permit the folded sheet to drop below the transport path.

11. An image forming system comprising:

an image forming unit that forms an image on a sheet;

a folding processing section that performs a folding operation on the sheet on which the image has been formed by the image forming unit, and forms a folded portion;

a pressing section that is disposed downstream from the folding processing section in a sheet transport direction, the pressing section including a first member that opposes the folded portion of the sheet that has been folded by the folding processing section, the pressing section pressing the folded portion; and a guiding section having a curved shape that is disposed downstream from the folding processing section in the sheet transport direction and upstream from the pressing section in the sheet transport direction, the guiding section nipping the sheet whose folded portion has passed through the guiding section and guiding the sheet to the pressing section while remaining stationary to permit the sheet to slide through the guide section.

12. The image forming system according to claim 11, wherein the first opposing member and the second opposing member are rollers.

13. The image forming system according to claim 11, wherein a lower surface of the guiding section is configured to move perpendicular with respect to the sheet transport direction to permit the folded sheet to drop below the transport path.

* * * * *